US010612341B2

(12) United States Patent
Williams et al.

(10) Patent No.: US 10,612,341 B2
(45) Date of Patent: Apr. 7, 2020

(54) BYPASS ASSEMBLY FOR PRODUCTION PACKER

(71) Applicant: EPIC LIFT SYSTEMS LLC, Fort Worth, TX (US)

(72) Inventors: Jason Williams, Fort Worth, TX (US); E. Andrew Borne, Fort Worth, TX (US)

(73) Assignee: EPIC LIFT SYSTEMS LLC, Fort Worth, TX (US)

( * ) Notice: Subject to any disclaimer, the term of this patent is extended or adjusted under 35 U.S.C. 154(b) by 77 days.

(21) Appl. No.: 16/038,907

(22) Filed: Jul. 18, 2018

(65) Prior Publication Data

US 2019/0024475 A1 Jan. 24, 2019

Related U.S. Application Data

(60) Provisional application No. 62/534,425, filed on Jul. 19, 2017.

(51) Int. Cl.

| | |
|---|---|
| ***E21B 34/04*** | (2006.01) |
| ***E21B 33/129*** | (2006.01) |
| ***E21B 34/06*** | (2006.01) |
| ***E21B 17/18*** | (2006.01) |
| ***E21B 33/12*** | (2006.01) |
| ***E21B 43/12*** | (2006.01) |
| ***E21B 34/10*** | (2006.01) |

(52) U.S. Cl.

CPC ..... *E21B 33/1294* (2013.01); *E21B 17/18* (2013.01); *E21B 33/12* (2013.01); *E21B 34/06* (2013.01); *E21B 34/10* (2013.01); *E21B 43/122* (2013.01)

(58) Field of Classification Search

CPC ..... E21B 33/1294; E21B 17/18
USPC ..... 166/129
See application file for complete search history.

(56) References Cited

U.S. PATENT DOCUMENTS

| | | | | |
|---|---|---|---|---|
| 6,095,249 | A * | 8/2000 | McGarian | E21B 21/002 166/319 |
| 2009/0159279 | A1* | 6/2009 | Assal | E21B 43/045 166/278 |
| 2010/0163235 | A1* | 7/2010 | Mootoo | E21B 21/10 166/278 |
| 2011/0061862 | A1* | 3/2011 | Loretz | E21B 33/1208 166/250.11 |

(Continued)

*Primary Examiner* — Taras P Bemko
(74) *Attorney, Agent, or Firm* — MH2 Technology Law Group LLP

(57) ABSTRACT

A bypass assembly for a packer includes a first adapter including a first central bore, a first radial opening communicating with the first central bore, and first axial openings prevented from fluid communication the first central bore. The bypass assembly includes a second adapter including a second central bore, a second radial opening communicating with the second central bore, and second axial openings prevented from fluid communication with the second central bore. The bypass assembly includes a tubular coupled to the first central bore and the second central bore, the tubular being configured to extend through the packer. A first flowpath is defined from the first radial opening through the tubular and the second radial opening, and a second flowpath is defined through the first axial openings, between the tubular and the packer, and through the second axial openings.

20 Claims, 8 Drawing Sheets

(56) References Cited

U.S. PATENT DOCUMENTS

| | | | | |
|---|---|---|---|---|
| 2015/0075781 | A1* | 3/2015 | Buechler | E21B 33/1208<br>166/250.01 |
| 2016/0160603 | A1* | 6/2016 | Sevadjian | E21B 33/14<br>166/288 |
| 2019/0257175 | A1* | 8/2019 | Gao | E21B 23/01 |

* cited by examiner

BYPASS ASSEMBLY FOR PRODUCTION PACKER

CROSS-REFERENCE TO RELATED APPLICATIONS

This application claims priority to U.S. Provisional Patent Application No. 62/534,425, filed on Jul. 19, 2017, the entirety of which is hereby incorporated by reference.

BACKGROUND

Production tubing is deployed into a well to support hydrocarbon recovery. Generally, formation fluid (e.g., hydrocarbons) produced from a formation through which the well extends is received into the production tubing. In some cases, compressed gas (lift gas) is pumped down into the annulus between the wellbore (or the casing) and the production tubing. The lift gas is received into the production tubing via the gas-lift valves or around the end of tubing, along with the formation fluid. Gas-lift valves provided along the length of the tubing string provide an entry point for the lift gas, and the gas assists lightening the fluid gradient and in channeling the formation fluid up through the production tubing and increasing velocity of the hydrocarbons. This process is referred to as "gas lift." The gas-lift valves may be opened depending on relative pressures to receive the lift gas. A variety of such processes have been implemented successfully in the industry.

In some such gas-lift processes, a packer may be positioned below the lowest gas-lift valve. When set, the packer seals the annulus, but provides a bore therethrough that allows communication with the interior of the production tubing. In some cases, formation fluids may be recoverable from below the packer, and thus the lift gas may be directed to the annulus between the second part of the production tubing (sometimes referred to as a "tail pipe"), again with the assistance of lift gas in the annulus and below. This lift gas, along with produced formation fluids, may be received through an open lower second end of the tail pipe, and then back through the production tubing.

In order for the lift gas to reach the annulus below the production packer, a packer bypass is sometimes used. The bypass provides a flowpath for the lift gas through the packer, separate from the flowpath for the produced fluids proceeding upwards through the packer. However, bypasses are often expensive, may reduce lift gas flow rates, and can be damaged or result in damage to the production tubing, e.g., fluid cuts or erosion in the crossover due to high fluid velocities.

SUMMARY

Embodiments of the disclosure may provide a bypass assembly for a packer. The bypass assembly includes a first adapter including a first central bore, a first radial opening extending radially outward from and communicating with the first central bore, and one or more first axial openings being prevented from fluid communication the first central bore. The bypass assembly includes a second adapter including a second central bore, a second radial opening extending radially outward from and communicating with the second central bore, and one or more second axial openings being prevented from fluid communication with the second central bore. The bypass assembly includes a tubular coupled to the first central bore and the second central bore, the tubular being configured to extend through the packer. A first flowpath is at least partially defined from the first radial opening, through the tubular, and through the second radial opening, and a second flowpath is at least partially defined through the one or more first axial openings, between the tubular and the packer, and through the one or more second axial openings.

Embodiments of the disclosure may also provide a bypass assembly for a packer. The bypass assembly includes a first adapter including a first central bore, a first radial opening extending radially outward from and communicating with the first central bore, and a plurality of first axial openings being prevented from fluid communication the first central bore. The first axial openings extend parallel to the first central bore and fluidly connect together first and second connections of the first adapter. The first axial openings are positioned along a first angular interval about a central axis of the first adapter. The first radial opening is positioned in a second angular interval around the central axis, such that the first axial openings extend axially past and do not intersect the first radial opening. The bypass assembly also includes a second adapter including a second central bore, a second radial opening extending radially outward from and communicating with the second central bore, and a plurality of second axial openings being prevented from fluid communication with the second central bore. The second axial openings extend parallel to the second central bore and fluidly connect together first and second connections of the second adapter. The second axial openings are positioned along a third angular interval about a central axis of the second adapter. The second radial opening is positioned in a fourth angular interval about the central axis, such that the second axial openings extend axially past and do not intersect the second radial opening. The first radial opening and the second radial opening are configured to be in fluid communication with one or more well annuli formed between a production tubular and a surrounding tubular. The bypass assembly also includes a tubular coupled to the first central bore and the second central bore. The tubular is configured to extend through the packer. The bypass assembly also includes a check valve received at least partially into and coupled to the first central bore. The tubular is coupled to the first central bore by connection with the check valve. A first flowpath is at least partially defined from the first radial opening, through the tubular, and through the second radial opening. A second flowpath is at least partially defined through the one or more first axial openings, between the tubular and the packer, and through the one or more second axial openings.

Embodiments of the disclosure may also provide a production string. The production string includes a packer including one or more sealing elements, a setting system configured to engage a surrounding tubular or a wellbore wall, a first end, a second end, and a bore extending between the first end and the second end. The production string includes an upper production tubular, and a first adapter coupled to an upper end of the packer and to the upper production tubular, the first adapter comprising a first central bore, a first radial opening extending radially outward from and communicating with the first central bore, and one or more first axial openings being prevented from fluid communication the first central bore. The production string includes a second adapter coupled to a lower end of the packer, the second adapter including a second central bore, a second radial opening extending radially outward from and communicating with the second central bore, and one or more second axial openings being prevented from fluid communication with the central bore. The production string includes a bypass tubular coupled to the first central bore and the second central bore, the bypass tubular extending through the packer. A first flowpath is at least partially defined from the first radial opening, through the bypass tubular, and through the second radial opening, and a second flowpath is at least partially defined through the one or more first axial openings, radially between the bypass tubular and the packer, and through the one or more second axial openings.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
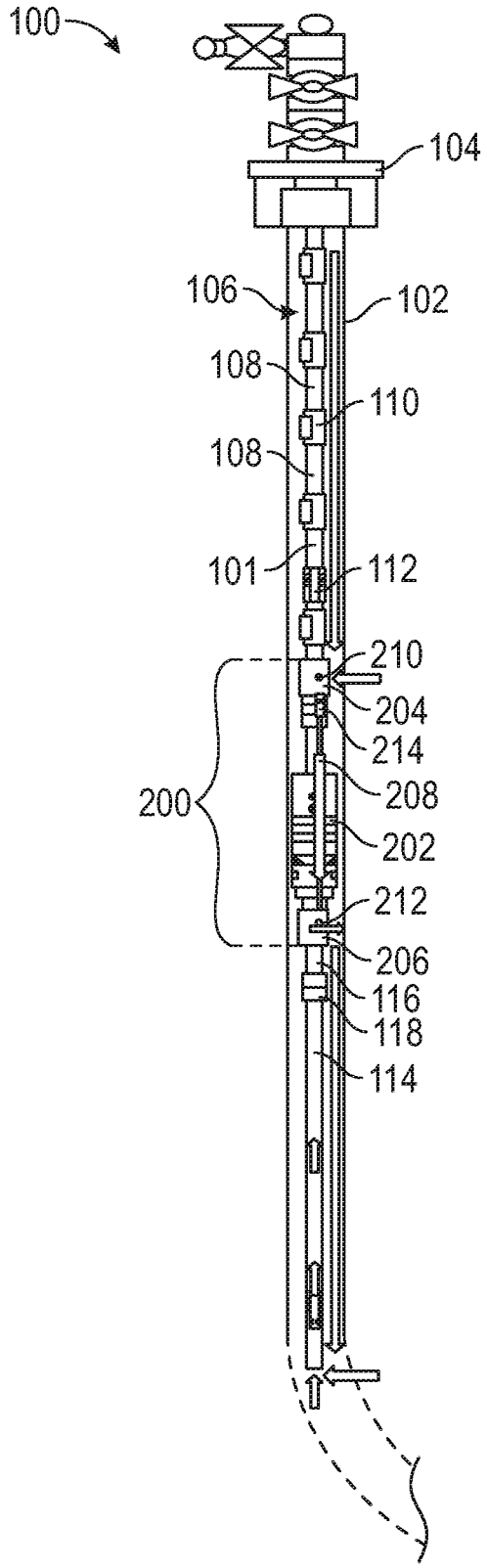
FIG. 1 illustrates a schematic view of a production string including a packer bypass assembly, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

As used herein, the terms "inner" and "outer"; "up" and "down"; "first" and "second"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

FIG. 1 illustrates a side, schematic view of a production assembly 100, including a production string 101 positioned in a surrounding tubular 102, according to an embodiment. The surrounding tubular 102 may form part of a well and may be representative of the wellbore wall, a casing (e.g., cemented into the well), or any other oilfield tubulars. The production string 101 may extend from a wellhead 104, which may include valves, pumps, compressors, etc. configured to control delivery of gas to and production of fluid from the well, e.g., via the production string 101. The production string 101 and the surrounding tubular 102 may define a wellbore annulus 106 therebetween, and injected gas may proceed through the wellbore annulus 106.

The production string 101 may include one or more lengths of production tubing 108. Each production tubing 108 may be representative of one or more links or joints of tubing, pipe, etc., through which a fluid may be channeled. The production string 101 may also include one or more gas-lift valves 110, which may provide for selective communication between the wellbore annulus 106 and the interior of the production tubing 108. The gas-lift valves 110 may be opened and/or closed depending on relative pressure, or by using any suitable valve shifting tool, or in response to an electrical or another type of signal. In some embodiments, the gas-lift valves 110 may be opened to receive gas from the wellbore annulus 106, which may be injected at a heightened pressure via the wellhead 104. In some embodiments, valves can also or instead be installed on the inside of the tubing 108 where gas is injected down the tubing 108 and fluid flows up the annulus 106. This may be referred to as unloading or increasing drawdown, and may be conducted in stages (e.g., by opening and closing successive valves 110), so as to provide lift to gas (e.g., hydrocarbons) within the production tubing 108 (or the annulus 106), and thereby assist in flowing such gas to the wellhead 104.

The production string 101 may further include one or more profile nipples 112 located at any position along the production string 101. The profile nipple 112 may have a profile inside that can accept multiple tools such as bumper springs, plugs, standing valves, etc., and may be used in conjunction with plunger lift and/or well control.

The production string 101 may further include a packer assembly 200. The packer assembly 200 may include a packer 202 and a bypass assembly, which may include a first adapter 204, a second adapter 206, and a tubular 208 coupled to and extending therebetween, as will be described in greater detail below. In some embodiments, the first adapter 204 may be positioned closer to the top surface of the well (e.g., wellhead 104) than the second adapter 206, and thus the first adapter 204 may be referred to herein as the "upper" adapter 204, while the second adapter 206 may be referred to herein as the "lower" adapter 206. However, it will be appreciated that the relative positioning of the first and second adapters 204, 206 may be switched, such that the second adapter 206 is closer to the top surface than the first adapter 204, without departing from the scope of the present disclosure.

The tubular 208 may be configured to extend axially through the packer 202, so as to provide fluid communication between the upper and lower adapters 204, 206. Further, the tubular 208 may be hollow and may be configured to channel fluids therethrough, between the upper and lower adapters 204, 206.

The adapters 204, 206 may be coupled to the packer 202, e.g., the upper adapter 204 may be coupled to an upper end of the packer 202 and the lower adapter 206 may be coupled to the lower end of the packer 202. As such, the packer 202 is intermediate of the upper and lower adapters 204, 206. Further, the upper adapter 204 may be coupled to the production tubing 108, and the lower adapter 206 may optionally be coupled to a tail pipe 114 that extends downward in the well, away from the packer 202. In some embodiments, the tail pipe 114 may be omitted. Further, in some embodiments, a joint of tubing 116 may extend from lower adapter 206, and may be coupled to the tail pipe 114 via a swivel 118.

The adapters 204, 206 may each include an opening 210, 212, respectively. The openings 210, 212 may provide for fluid communication between the wellbore annulus 106 and the interior of the tubular 208. However, the adapters 204, 206 may block direct communication between the wellbore annulus 106 and the production tubing 108 via the openings 210, 212, as will be described in greater detail below.

The bypass assembly may further include one or more check valves 214. The check valve 214 may be configured to permit fluid communication via the tubular 208 from the opening 210 in the upper adapter 204 to the opening 212 in the lower adapter 206, and may prevent fluid communication in the reverse direction. Although illustrated as positioned within the upper adapter 204, it will be appreciated that the check valve 214 may be positioned anywhere within the downward flowpath provided by the bypass assembly.

Figure 2:
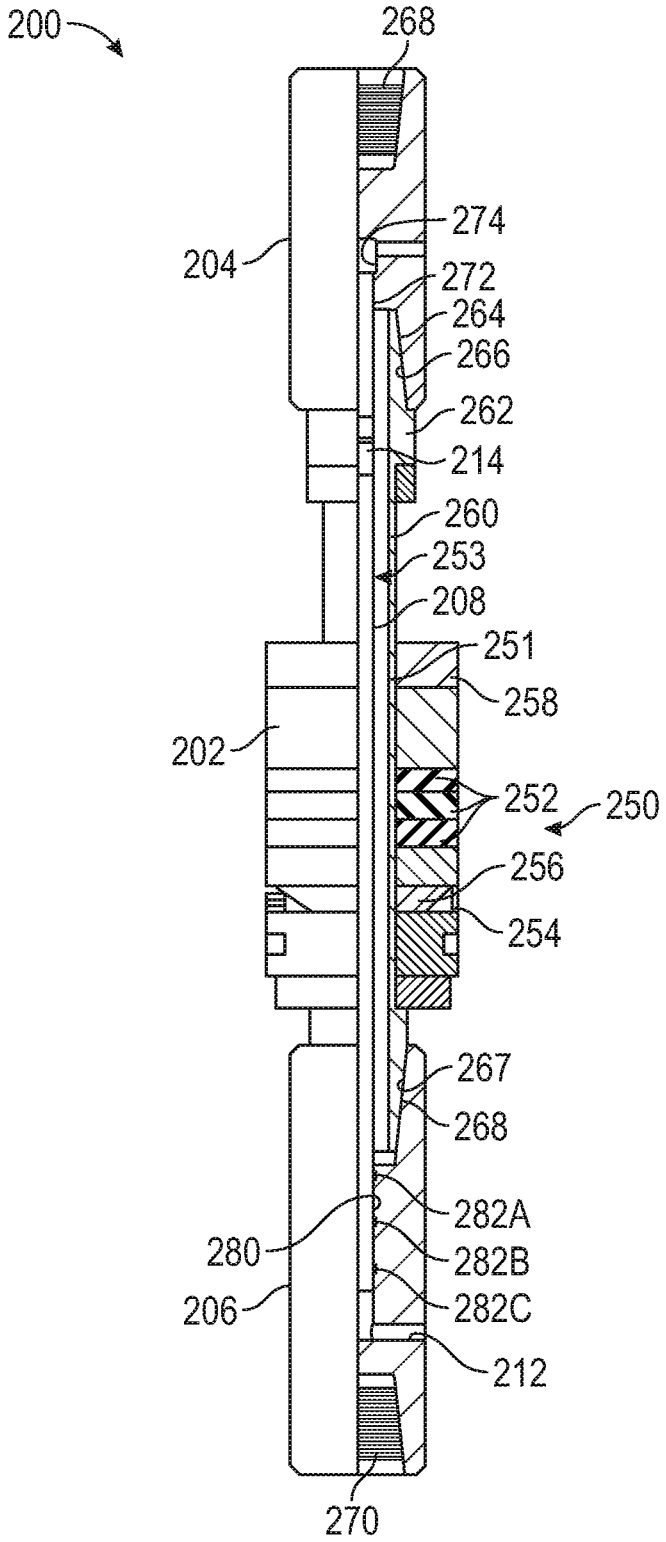
FIG. 2 illustrates a quarter-sectional view of a packer bypass assembly and a packer, according to an embodiment.

FIG. 2 illustrates a side, half-sectional view of the packer assembly 200, according to an embodiment. As mentioned above, the packer assembly 200 includes the packer 202, and the bypass assembly that includes the upper adapter 204, the lower adapter 206, and the tubular 208 extending between the adapters 204, 206, through the packer 202. Further, the upper adapter 204 includes the opening 210, and the lower adapter 206 includes the opening 212.

The packer 202 further includes a bore 251, through which the tubular 208 extends, such that a packer annulus 253 is defined therebetween. The packer 202 also includes a setting assembly 250, which may include one or more (e.g., rubber) sealing elements 252, slips 254, cones 256, and collars 258, and the like. The setting assembly 250 may be configured to axially contract and radially expand the sealing elements 252 and the slips 254 into engagement with the surrounding tubular 102 (FIG. 1). A variety of such setting assemblies may be employed in accordance with the present disclosure, with the illustrated assembly being provided merely as an example.

The packer 202 may also include a neck 260, which may extend upwards from the setting assembly 250. A collar 262 may be coupled to the neck 260, and may provide a threaded upper end 264 of the packer 202. The threaded upper end 264 may be received into a threaded connection 266 of the upper adapter 204, resulting in the packer 202 being connected to, e.g., fixed to, the upper adapter 204 via the threaded engagement. Similarly, a threaded lower end 267 of the packer 202 may be received into a threaded connection 268 of the lower adapter 206, so as to connect the packer 202 to the threaded lower end 267 via threaded engagement therebetween. It will be appreciated that any or all of the threaded connections referred to herein may be replaced with other types of connections, without departing from the scope of the present disclosure.

The upper adapter 204 may further include an upper connection 268, which may be threaded and may be configured to connect with the production tubing 108 (FIG. 1). Similarly, the lower adapter 206 may include a lower connection 270, which may also be threaded, and, referring to FIG. 1, may be configured to connect to the tail pipe 114, another production tubing 116, or may remain open, depending on the configuration of the production string 101. In some embodiments, the lower connections 266, 270 of the respective adapters 204, 206 may be externally ("male") threaded, rather than internally ("female") threaded.

Further, an upper end 272 of the tubular 208 may be threaded, and may be received into a central bore 274 of the upper adapter 204. The central bore 274 may include a threaded connection 276, which may connect with the threaded upper end 272 of the tubular 208, thereby securing (e.g., fixing) the tubular 208 to the upper adapter 204. A lower end 278 of the tubular 208 may not be threaded, but may be received (e.g., slid) into a central bore 280 of the lower adapter 206. The lower adapter 206 may include one or more sealing elements (e.g., three are shown: 282A, 282B, 282C), which may extend inwards from the central bore 280 and engage an outer surface of the tubular 208. The sealing elements 282A-C may thus allow for the distance between the upper and lower adapters 204, 206 to change slightly (e.g., by stretching the packer 202 under a load), and/or the upper and lower adapters 204, 206 to rotate or twist with respect to one another, without damaging the tubular 208.

Figure 3:
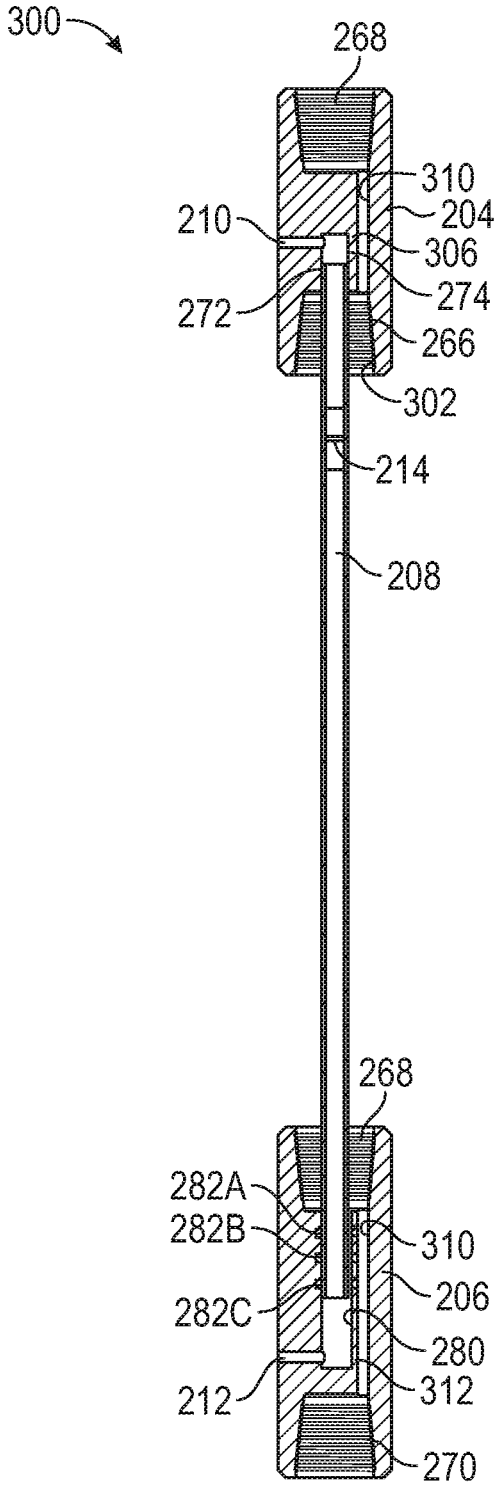
FIG. 3 illustrates a cross-sectional view of the packer bypass assembly (of FIG. 2), according to an embodiment.

FIG. 3 illustrates a cross-sectional view of the bypass assembly, indicated now with reference number 300, according to an embodiment. As can be seen in the fully cross-sectional view, each of the upper and lower adapters 204, 206 provides two flowpaths: one that allows fluid communication axially therethrough, and one that allows fluid communication between the openings 210, 212, via the interior of the tubular 208.

Referring to the upper adapter 204, the upper adapter 204 includes the threaded connection 266, as previously mentioned. This threaded connection 266 is formed in an outer bore 302 of the upper adapter 204. The outer bore 302 may extend entirely axially through the upper adapter 204, thereby allowing for fluid communication from the upper connection 268 to the lower connection 266. Thus, when the production tubing 108 is attached to the upper connection 268, it may communicate with the bore 251 of the packer 202, particularly the packer annulus 253 that is radially between the tubular 208 and the bore 251.

The tubular 208 may be received through the outer bore 302 and into a central bore 274 defined by a cap member 306. The opening 210 may communicate with the central bore 274, and thus may extend through the cap member 306. The cap member 306 may, however, prevent fluid communication between the interior of the tubular 208 and the outer bore 310.

Figure 4A:
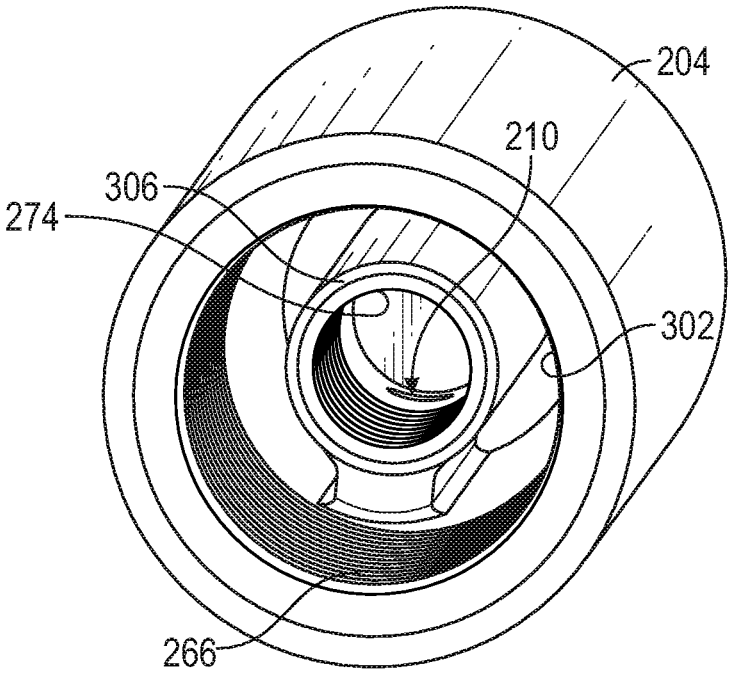
FIG. 4A illustrates a perspective view of an upper adapter of the bypass assembly (of FIG. 2), according to an embodiment.

FIG. 4A illustrates a perspective view of the upper adapter 204, showing the outer bore 302, the cap member 306, the central bore 274, and the opening 210. As can be seen, fluid communication is provided around the cap member 306, between the upper connection 268 and the lower connection 266 (and vice versa), while the tubular 208 received into the cap member 306 is prevented from fluid communication with the outer bore 302.

Figure 4B:
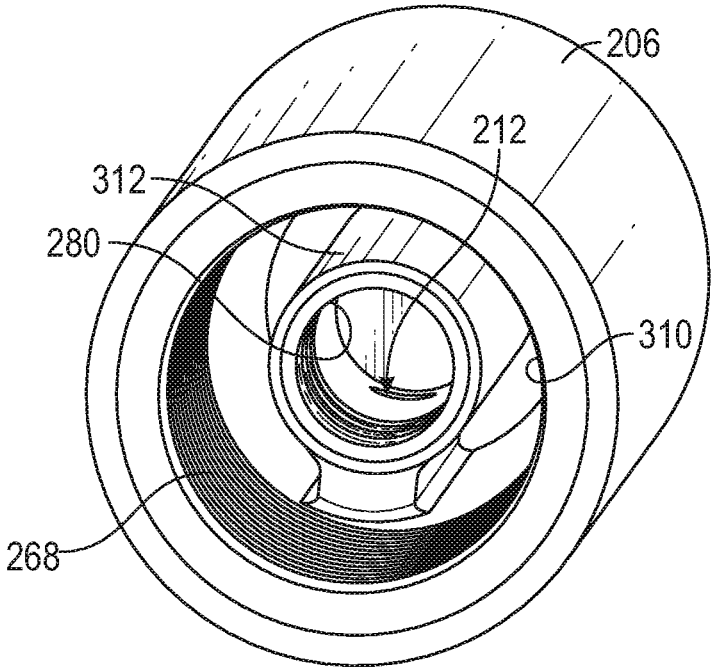
FIG. 4B illustrates a perspective view of a lower adapter of the bypass assembly (of FIG. 2), according to an embodiment.

FIG. 4B illustrates a perspective view of the lower adapter 206, according to an embodiment. Referring to FIGS. 3 and 4B, the lower adapter 206 may similarly provide an outer bore 310 extending between the upper connection 268 and the lower connection 270, so as to provide fluid communication axially through the lower adapter 206. The lower adapter 206 may also include a cap member 312 extending radially inward into the outer bore 310. The cap member 312 may define at least a portion of the central bore 280, in which the sealing elements 282A-C may be positioned, and in which the lower end of the tubular 208 may be (e.g., slidingly) received. The opening 212 may extend through the cap member 312, and may communicate with the interior of the tubular 208 via the central bore 280.

Accordingly, referring to FIGS. 2-4B, the packer assembly 200, including the bypass assembly 300, may provide for two flowpaths through the packer 202. The first flowpath may extend from the opening 210 in the upper adapter 204, to the central bore 274, through the interior of the tubular 208, to the central bore 280 of the lower adapter 206, and through the opening 212. The second flowpath may extend from the lower connection 270 of the lower adapter 206, around the cap member 312 and through the outer bore 310, through the packer annulus 253, through the outer bore 302 of the upper adapter 204 and around the cap member 306, and through the upper connection 268. The two flowpaths may be prevented from intersecting within the packer assembly 200. In some embodiments, the first flowpath may provide a down-going flowpath for injection gas, while the second flowpath may provide an up-going flowpath for production fluid. It will be appreciated that the direction of these flowpaths is merely an example, and these directions may be reversed or otherwise modified without departing from the scope of this disclosure.

Further, in some embodiments, the adaptors 204, 206 may be fitted with a gas lift valve or screened orifice. This option may facilitate the inclusion of an injection control, such as a valve or orifice. For example, a hanger mandrel may be connected to the upper and lower adapters 204, 206, and may extend therebetween.

Figure 5:
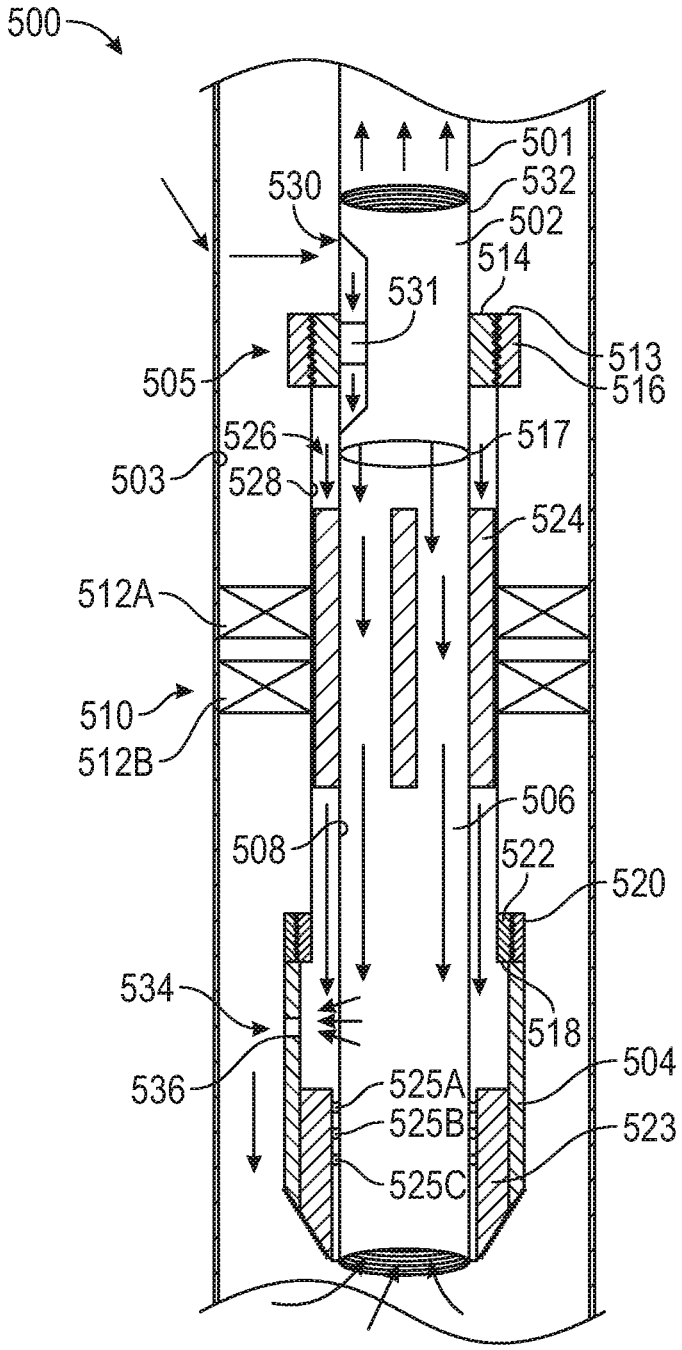
FIG. 5 illustrates a schematic, simplified cross-sectional view of another packer bypass assembly, according to an embodiment.

FIG. 5 illustrates a schematic, cross-sectional view of a bypass assembly 500, according to an embodiment. The bypass assembly 500 may be configured to provide two flowpaths, similar to the bypass assembly 300 discussed above, and thus at least some aspects of each may not be mutually exclusive. Further, the bypass assembly 500 may also be part of a production string deployed into a well, e.g., as shown in FIG. 1. Accordingly, the bypass assembly 500 may be connected at a top end thereof to a production tubing 501, as shown. The production tubing 501 and a surrounding tubular 503, e.g., the wellbore wall, a casing, or the like, may define a wellbore annulus 505.

The bypass assembly 500 may include a first or "upper" adapter 502, a second or "lower" adapter 504, and a tubular 506 extending therebetween. The tubular 506 may be hollow, and may be configured to channel a fluid therein, between the upper and lower adapters 502, 504. The tubular 506 may extend through a bore 508 of a packer 510, which may include one or more sealing elements (two shown: 512A, 512B), which may be expandable to seal with or otherwise engage the surrounding tubular 503, so as to block the annulus 505. In an embodiment, the adapters 502, 504 and the tubular 506 may have the same outer diameter, such that when they are connected together, end-to-end, a continuous tubular of generally constant outer diameter is formed. In other embodiments, however, these components may have different outer diameters.

The upper adapter 502 may be connected to the packer 510, e.g., at an upper end 513 thereof, so as to be held in place with respect thereto. For example, the upper adapter 502 may include an annular ring or "lug" 514, which may extend partially or entirely around the upper adapter 502. The lug 514 may provide threads, which may engage threads of a first connector 516 of the packer 510. For example, the outer circumference of the lug 514 may provide such threads, and may be received into the packer 510, so as to be connected to threads extending inward from the inner diameter surface of the connector 516, as shown. In other embodiments, the upper adapter 502 may be connected to the packer 510 using any number of other arrangements. The upper adapter 502 may also include a lower end 517 that is coupled to (e.g., fixed via meshing threads) the tubular 506.

The lower adapter 504 may also be connected to the packer 510, e.g., to a lower end 518 thereof. As such, the packer 510 is axially between the upper and lower adapters 502, 504. For example, the lower adapter 504 may include a threaded upper end 520, in which threads are defined on the inner diameter surface. The threaded upper end 520 may receive and couple to a threaded second connector 522 of the packer 510, with threads of the threaded second connector 522 being defined in the outer diameter surface thereof. In other embodiments, other types of connecting arrangements may be employed to attach the lower adapter 504 to the packer 510.

The lower adapter 504 may further include a lower connection 523. The lower connection 523 may include one or more seals (three shown: 525A, 525B, 525C) extending radially inward and into engagement with the tubular 506. The lower adapter 504 may slidingly engage the tubular 208 using the seals 525A-C. Further, the lower connection 523 may be configured to connect with a tail pipe, or may be open, so as to receive fluids therethrough.

One or more centralizer ribs 524 may extend radially from the tubular 506, and may be positioned, sized, or otherwise configured to maintain an annulus 526 between the tubular 506 and a bore 528 of the packer 510. In some embodiments, the centralizer ribs 524 may be uniformly spaced at angular intervals, e.g., every 60 degrees. In other embodiments, the centralizer ribs 524 may be disposed in any other pattern. Further, the standoff created between the tubular 506 and the bore 528 by the centralizer ribs 524 need not be annular, and could instead be configured to place the tubular 506 eccentric to the bore 528 (e.g., off to one side, as shown in cross-section).

Further, the upper adapter 502 may provide a first injection flowpath 530, which may be a groove, channel, conduit, bore, or recess in a wall of the upper adapter 502. A check valve 531 may be positioned in the first injection flowpath 530, and may allow fluid flow in a single direction (e.g., downwards, as shown) therethrough. For example, the upper adapter 502 may be threaded in the first injection flowpath 530, and the check valve 531 may provide threads that mesh with the threads in the first injection flowpath 530, so as to secure the check valve 531 therein. In other embodiments, the check valve 531 may be secured in other manners, such as with adhesives, welding, brazing, etc.

The first injection flowpath 530 may extend and allow fluid flow axially past the lug 514 and into the annulus 526. In some embodiments, as shown, the first injection flowpath 530 may extend radially inwards from an outer surface 532 of the upper adapter 502, then axially past the lug 514, then radially outward to the outer surface 532, where the first injection flowpath 530 may communicate with the annulus 526.

Similarly, the lower adapter 504 may provide a second injection flowpath 534. The second injection flowpath 534 may include a port 536 extending radially outward through the lower adapter 504. The second injection flowpath 534 may, for example, be positioned above the lower connection 523 and the seals 525A-C, thereby permitting fluid communication from the annulus 526 between the tubular 506 and the bore 528 to the well annulus 505.

Accordingly, the bypass assembly 500 may operate to provide two flowpaths, which may be prevented from intersecting within the bypass assembly 500. The first flowpath may be provided for gas injection, and may extend from the first injection flowpath 530 of the upper adapter 502, through the annulus 526 and between the centralizer ribs 524, and out through the second injection flowpath 534. The second flowpath may extend axially within and through the lower adapter 504, the tubular 506, and the upper adapter 502. It will be appreciated that the flow direction is provided merely as an illustration and may be reversed in some applications.

Figure 6:
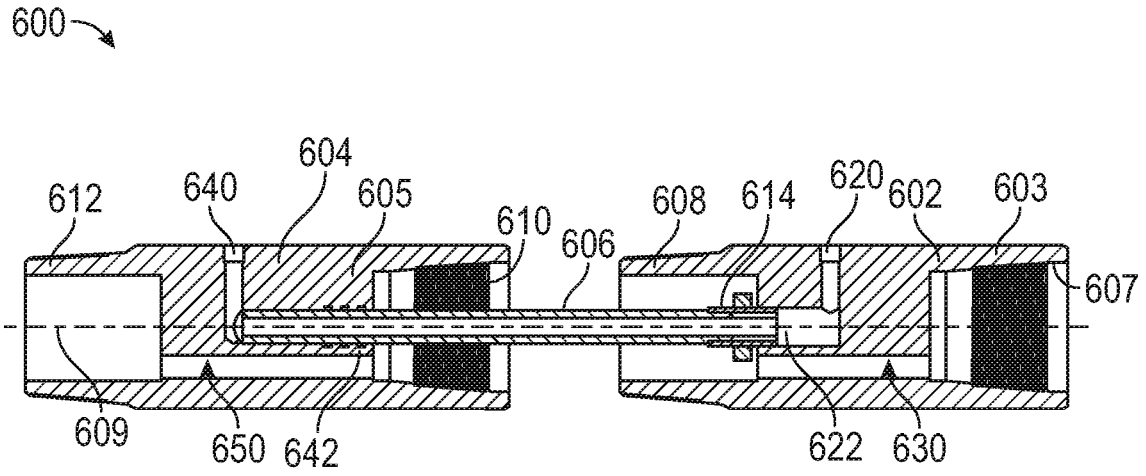
FIG. 6 illustrates a cross-sectional view of another packer bypass assembly, according to an embodiment.

FIG. 6 illustrates a cross-sectional view of another bypass packer assembly 600, according to an embodiment. The bypass packer assembly 600 may include an upper adapter 602, a lower adapter 604, and a tubular 606 that extends from the upper adapter 602 to the lower adapter 604. In some embodiments, the upper and lower adapters 602, 604 and the tubular 606 may be concentric, and may thus together define a central axis 609. In other embodiments, the upper and lower adapters 602, 604 may not be concentric and thus may define separate central axes. The bypass packer assembly 600 may be configured to provide dual flowpaths through a packer, similar to the bypass packer assembly 300 described above, and thus may similarly be positioned with a packer coupled to and intermediate of the upper and lower adapters 602, 604.

The upper adapter 602 may include a body 603. The upper end of the upper adapter 602 may include a threaded connection 607 for attachment of the body 603 to a production tubular above the packer. The lower end of the upper adapter 602 may include a threaded connection 608 for attachment of the body 603 to the packer.

The lower adapter 604 may include a body 605. The upper end of the lower adapter 604 may include a threaded connection 610 for attachment of the body 605 to the lower end of the packer. The lower end of the lower adapter 604 may include a threaded connection 612 for attachment of the body 605 to a tail pipe, e.g., another section of the production tubing, below the packer in the well. The tubular 606 may extend through the packer, connecting together the upper and lower adapters 602, 604.

A check valve 614 may be coupled to the tubular 606, and may be configured to permit flow in the tubular 606 from the upper adapter 602 towards the lower adapter 604, but prevent flow in the reverse direction via the tubular 606. In some embodiments, the check valve 614 may be a ball check valve, flapper valve, or another type of one-way valve.

The upper adapter 602 may include a radial opening 620, for receiving fluids, as shown, from an upper annulus defined above the packer and between the production tubular and a surrounding tubular of the well. The upper adapter 602 may also include a central bore 622 that receives the tubular 606 and directs fluids from the opening 620 to the tubular 606. The central bore 622 may be threaded, so as to be coupled to the tubular 606, e.g., via the check valve 614. The upper adapter 602 includes an axial flowpath 630, which, as will be described in greater detail below, is prevented from communication with the radial opening 620.

The lower adapter 604 may include a radial opening 640, for directing fluids radially outward, as shown, and into a lower annulus defined below the packer and, e.g., between the tail pipe and the surrounding tubular of the well. As explained above, the packer may isolate the upper annulus from communication with the lower annulus, with the bypass assembly being configured to establish communication therebetween in a controlled manner.

The lower adapter 604 may also include a central bore 642 for receiving the tubular 606 and directing fluids received therefrom to the radial opening 640. The lower adapter 604 also defines an axial flowpath 650, which, as will be described in greater detail below, is prevented from communication with the radial opening 640.

Figure 7:
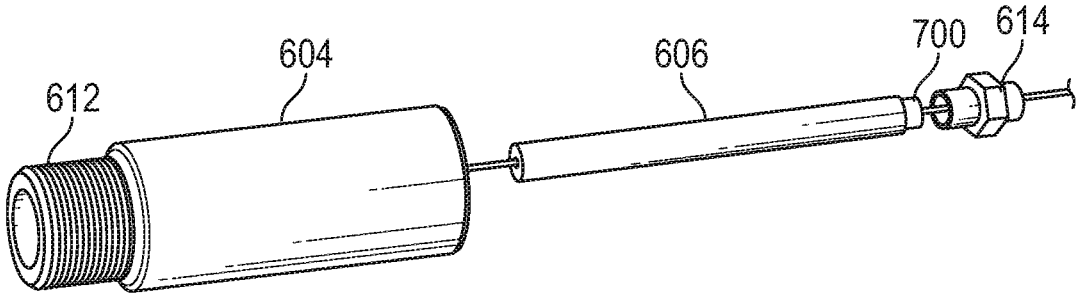
FIG. 7 illustrates a perspective, exploded view of an upper adapter, a tubular, and a check valve of the packer bypass assembly of FIG. 6, according to an embodiment.

FIG. 7 illustrates a perspective exploded view of the lower adapter 604, the tubular 606, and the check valve 614. As shown, the check valve 614 may be coupled to an upper end 700 of the tubular 606, e.g., via a threaded coupling; however, in other embodiments, the check valve 614 may be positioned at a lower end of the tubular 606 or elsewhere in the upper and/or lower adapters 602, 604.

Figure 8A:
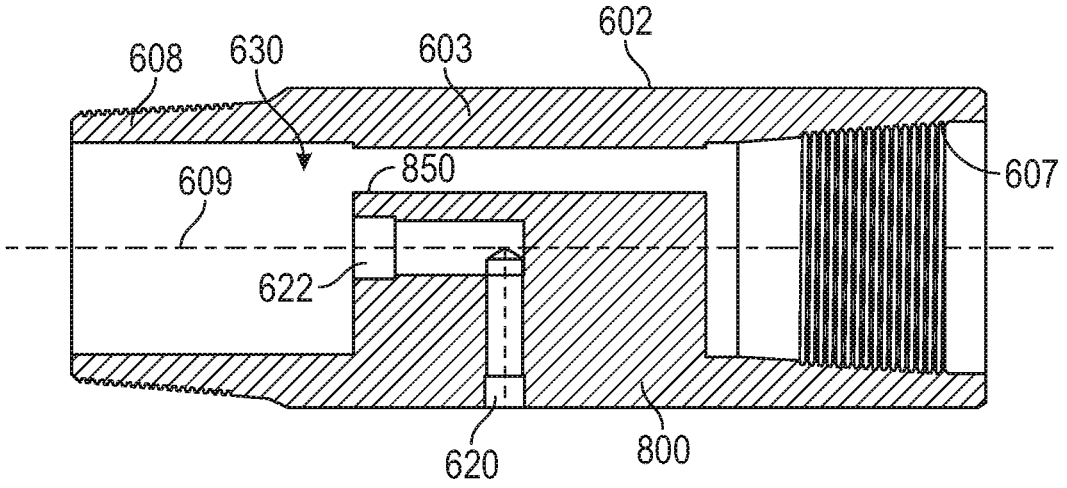
FIG. 8A illustrates a perspective view of an upper adapter of the packer bypass assembly of FIG. 6, according to an embodiment.
Figure 8B:
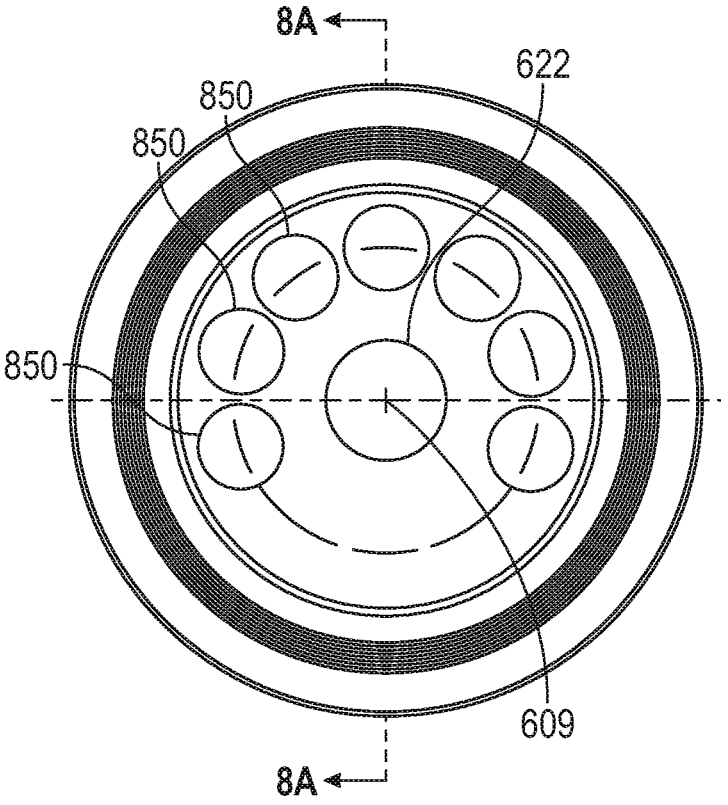
FIG. 8B illustrates a side, cross-sectional view of the upper adapter of FIG. 8A, according to an embodiment.

FIG. 8A illustrates side, cross-sectional view of the upper adapter 602, according to an embodiment. FIG. 8B illustrates an axial end view of the upper adapter, with FIG. 8A being taken along line 8A-8A, as shown. As mentioned above, the upper adapter 602 may include upper and lower threaded connections 607, 608, as shown, which may form two portions of an outer bore, with an intermediate portion 800 of the body 603 remaining therebetween. Thus, these connections 607, 608 may define blind holes in the body 603 extending axially into the upper adapter 602, leaving the intermediate portion 800 separating the connections 607, 608, as shown. The radial opening 620 and the central bore 622 may be defined in the intermediate portion 800, e.g., with the central bore 622 extending axially until intersecting with the radial opening 620. Further, the central bore 622 may be threaded for connection with the tubular 606 and/or the check valve 614 (FIG. 6).

Further, the central bore 622 may occupy the center of the upper adapter 602, and one or more axial openings 850 may be positioned in the intermediate portion 800, partially around the central bore 622, so as to allow fluid communication between the connections 607, 608, thereby establishing the axial flowpath 630 through the upper adapter 602.

The axial openings 850 may be positioned so as to avoid intersecting and thus exposing the radial opening 620 to the axial flowpath 630. For example, the axial openings 850 may be positioned on a first angular interval, but not on a second angular interval another, with the radial opening 620 being in the second angular interval in which the axial openings 850 are not positioned. In some embodiments, the central bore 622 may not be positioned in the center of the upper adapter 602 (e.g., may not be positioned along the central axis 609), and the axial openings 850 may be positioned along an angular interval with respect to either of the central axis 609 or the central bore 622. Further, any number of axial openings 850 may be formed, and the axial openings 850 may be separated apart about the axis 609, or may be touching or overlapping one another.

The central bore 622 may be threaded for connection with the check valve 614 and/or the tubular 606, in some embodiments, but in other embodiments, may be configured to connect to the tubular 606 and/or check valve 614 in any suitable manner. With the tubular 606 received into the central bore 622 or coupled thereto via the check valve 614, fluid directed into the tubular 606 may be prevented from communication with the axial flowpath 630, at least within the upper adapter 602.

Figure 9A:
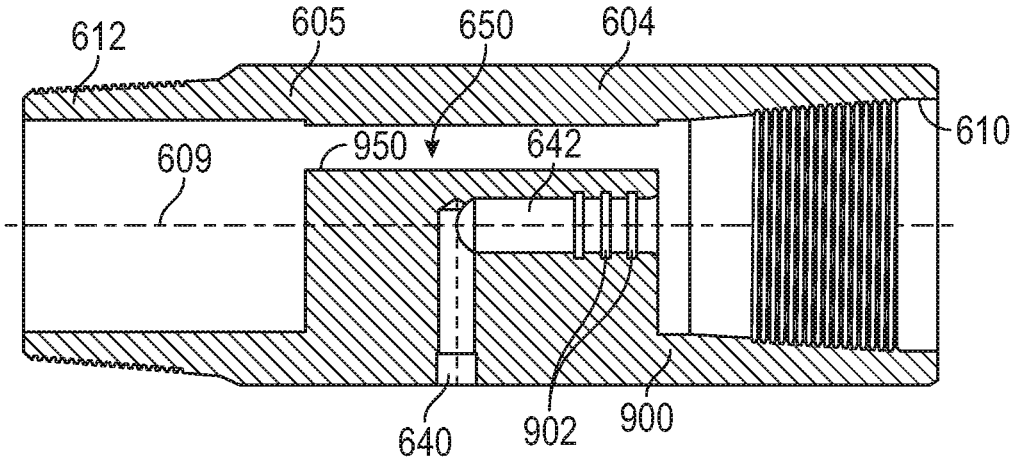
FIG. 9A illustrates a perspective view of a lower adapter of the packer bypass assembly of FIG. 6, according to an embodiment.
Figure 9B:
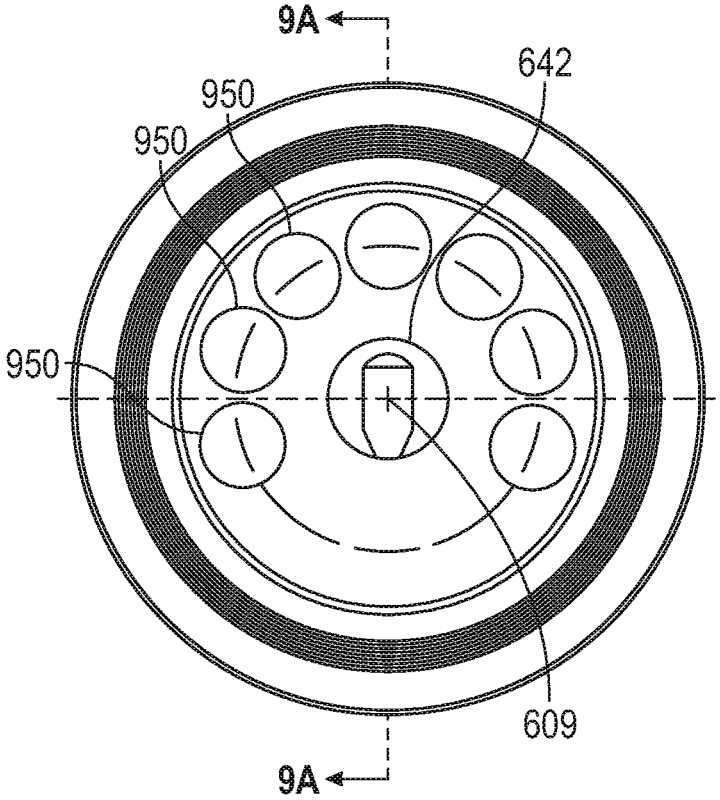
FIG. 9B illustrates a side, cross-sectional view of the lower adapter of FIG. 9A, according to an embodiment.

FIGS. 9A and 9B illustrate a side, cross-sectional view and an axial end view of the lower adapter 604, according to an embodiment. In particular, the cross-section of FIG. 9A is taken along line 9A-9A of FIG. 9B. Like the upper adapter 602, the body 605 of the lower adapter 604 may define an intermediate portion 900 between the two connections 610, 612, which may be blind holes bored into the axial ends of the lower adapter 604. The central bore 642 and the radial opening 640 may be formed in the intermediate portion 900, and may intersect therein. Further, the central bore 642 may include one or more seal recesses 902, in which seals (e.g., O-rings) may be positioned for sealing with the tubular 606 (FIG. 6) that is received therein. Accordingly, the tubular 606 may be slid into and form a seal with the tubular 606, such that a range of relative displacement therebetween is allowed without losing the seal.

Axial openings 950 may be drilled or otherwise formed through the intermediate portion 900 so as to fluidly connect the connections 610, 612 and establish the axial flowpath 650 through the lower adapter 604, while avoiding intersecting the radial opening 640. As seen in the end-view of FIG. 9B, several axial openings 950 may be formed, e.g., along a third angular interval around at least a portion of the central axis 609 and/or the central bore 642 of the lower adapter 604. In some embodiments, the first and third angular intervals for the axial openings 850, 950 of the adapters 602, 604 may be the same or overlapping, but in other embodiments, they may be at least partially or entirely different.

The axial openings 950 may not be formed along a fourth angular interval. This may be the area of the intermediate portion 900 where the radial opening 640 is positioned, and thus the axial openings 950 may be positioned so as to avoid intersecting the radial opening 640, thus avoiding exposing the radial opening 640 to the axial flowpath 650. The axial openings 950 may be formed as touching or separated. Further, any number of axial openings 950 may be employed, including a single axial openings 950.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A bypass assembly for a packer, comprising:

a first adapter comprising a first central bore, a first radial opening extending radially outward from and communicating with the first central bore, and one or more first axial openings being prevented from fluid communication with the first central bore;

a second adapter comprising a second central bore, a second radial opening extending radially outward from and communicating with the second central bore, and one or more second axial openings being prevented from fluid communication with the second central bore; and a tubular coupled to the first central bore and the second central bore, the tubular being configured to extend through the packer, wherein a first flowpath is at least partially defined from the first radial opening, through the tubular, and through the second radial opening, and wherein a second flowpath is at least partially defined through the one or more first axial openings, between the tubular and the packer, and through the one or more second axial openings.

2. The bypass assembly of claim 1, wherein:

the first adapter comprises a body having a first connection for connecting to a production tubular, and a second connection for connecting to the packer;

the body defines an intermediate portion axially between the first and second connections; and the first central bore, the one or more first axial openings, and the first radial opening are defined in the intermediate portion of the body of the first adapter.

3. The bypass assembly of claim 2, wherein:

the second adapter comprises a body having a first connection for connecting to a tail pipe, and a second connection for connecting to the packer;

the body defines an intermediate portion axially between the first and second connections thereof; and the second central bore, the one or more second axial openings, and the second radial opening are defined in the intermediate portion of the body of the second adapter.

4. The bypass assembly of claim 3, wherein:

the one or more first axial openings extend parallel to the first central bore and fluidly connect together the first and second connections of the first adapter; and the one or more second axial openings extend parallel to the second central bore and fluidly connect together the first and second connections of the second adapter.

5. The bypass assembly of claim 1, further comprising a check valve coupled to the tubular.

6. The bypass assembly of claim 5, wherein the check valve is received at least partially into and coupled to the first central bore, and wherein the tubular is coupled to the first central bore by connection with the check valve.

7. The bypass assembly of claim 1, wherein the tubular is slid partially into the second central bore and forms a seal therewith, such that the tubular and the second central bore are relatively displaceable over a range of motion without losing the seal.

8. The bypass assembly of claim 1, wherein the first radial opening and the second radial opening are configured to be in fluid communication with one or more well annuli formed between a production tubular and a surrounding tubular.

9. The bypass assembly of claim 1, wherein the one or more first axial openings comprise a plurality of first axial openings positioned along a first angular interval about a central axis of the first adapter, wherein the first radial opening is positioned in a second angular interval around the central axis, such that the plurality of first axial openings extend axially past and do not intersect the first radial opening.

10. The bypass assembly of claim 9, wherein the one or more second axial openings comprise a plurality of second axial openings positioned along a third angular interval about a central axis of the second adapter, wherein the second radial opening is positioned in a fourth angular interval about the central axis, such that the plurality of second axial openings extend axially past and do not intersect the second radial opening.

11. The bypass assembly of claim 10, wherein the first central bore extends along the central axis of the first adapter, and wherein the second central bore extends along the central axis of the second adapter.

12. A bypass assembly for a packer, comprising:

a first adapter comprising:

a first central bore;

a first radial opening extending radially outward from and communicating with the first central bore; and a plurality of first axial openings being prevented from fluid communication with the first central bore, wherein:

the first axial openings extend parallel to the first central bore and fluidly connect together first and second connections of the first adapter, the first axial openings are positioned along a first angular interval about a central axis of the first adapter, the first radial opening is positioned in a second angular interval around the central axis, such that the first axial openings extend axially past and do not intersect the first radial opening;

a second adapter comprising:

a second central bore;

a second radial opening extending radially outward from and communicating with the second central bore; and a plurality of second axial openings being prevented from fluid communication with the second central bore, wherein:

the second axial openings extend parallel to the second central bore and fluidly connect together first and second connections of the second adapter, the second axial openings are positioned along a third angular interval about a central axis of the second adapter, the second radial opening is positioned in a fourth angular interval about the central axis, such that the second axial openings extend axially past and do not intersect the second radial opening, and the first radial opening and the second radial opening are configured to be in fluid communication with one or more well annuli formed between a production tubular and a surrounding tubular;

a tubular coupled to the first central bore and the second central bore, the tubular being configured to extend through the packer; and a check valve received at least partially into and coupled to the first central bore, wherein the tubular is coupled to the first central bore by connection with the check valve, wherein a first flowpath is at least partially defined from the first radial opening, through the tubular, and through the second radial opening, and wherein a second flowpath is at least partially defined through the first axial openings, between the tubular and the packer, and through the second axial openings.

13. The bypass assembly of claim 12, wherein the tubular is slid partially into the second central bore and forms a seal therewith, such that the tubular and the second central bore are relatively displaceable over a range of motion without losing the seal.

14. A production string, comprising:

a packer comprising one or more sealing elements, a setting system configured to engage a surrounding tubular or a wellbore wall, a first end, a second end, and a bore extending between the first end and the second end;

an upper production tubular;

a first adapter coupled to an upper end of the packer and to the upper production tubular, the first adapter comprising a first central bore, a first radial opening extending radially outward from and communicating with the first central bore, and one or more first axial openings being prevented from fluid communication with the first central bore;

a second adapter coupled to a lower end of the packer, the second adapter comprising a second central bore, a second radial opening extending radially outward from and communicating with the second central bore, and one or more second axial openings being prevented from fluid communication with the second central bore; and a bypass tubular coupled to the first central bore and the second central bore, the bypass tubular extending through the packer, wherein a first flowpath is at least partially defined from the first radial opening, through the bypass tubular, and through the second radial opening, and wherein a second flowpath is at least partially defined through the one or more first axial openings, radially between the bypass tubular and the packer, and through the one or more second axial openings.

15. The production string of claim 14, further comprising a tail pipe coupled to the second adapter, wherein, when the production string is deployed, an upper annulus is defined between the upper production tubular and the surrounding tubular or the wellbore wall, the first radial opening being in fluid communication with the upper annulus, and a lower annulus is defined between the tail pipe and the surrounding tubular or the wellbore wall, the second radial opening being in fluid communication with the lower annulus, the packer being configured to isolate the upper annulus from the lower annulus.

16. The production string of claim 14, wherein:

the first adapter comprises a body having a first connection for connecting to an upper production tubular, and a second connection connected to the packer, wherein the body defines an intermediate portion between the first and second connections, and the first central bore, the one or more first axial openings, and the first radial opening are defined in the intermediate portion of the body of the first adapter; and the second adapter comprises a body having a first connection connected to a lower production tubular, and a second connection connected to the packer, wherein the body of the second adapter defines an intermediate portion between the first and second connections thereof, and wherein the second central bore, the one or more second axial openings, and the second radial opening are defined in the intermediate portion of the body of the second adapter.

17. The production string of claim 16, wherein:

the one or more first axial openings extend parallel to the first central bore; and the one or more second axial openings extend parallel to the second central bore.

18. The production string of claim 14, further comprising a check valve coupled to the bypass tubular and configured to prevent fluid flow in the first flowpath from the second radial opening to the first radial opening.

19. The production string of claim 14, wherein:

the one or more first axial openings comprise a plurality of first axial openings positioned along a first angular interval about a central axis of the first adapter, wherein the first radial opening is positioned in a second angular interval around the central axis, such that the plurality of first axial openings extend axially past and do not intersect the first radial opening; and the one or more second axial openings comprise a plurality of second axial openings positioned along a third angular interval around a central axis of the second adapter, wherein the second radial opening is positioned in a fourth angular interval around the central axis, such that the plurality of second axial openings extend axially past and do not intersect the second radial opening.

20. The production string of claim 19, wherein the first central bore extends along the central axis of the first adapter, and wherein the second central bore extends along the central axis of the second adapter.

* * * * *